US005984063A

United States Patent [19]

Wallace III et al.

[11] Patent Number: 5,984,063

[45] Date of Patent: Nov. 16, 1999

[54] METHOD AND APPARATUS OF MINIMIZING WRINKLES DURING THE TRANSPORTATION AND STORAGE OF GARMENTS

[76] Inventors: Robert N. Wallace III; Aseniah M. Thompson-Wallace, both of 6 Beth Cir., Acton, Mass. 01720

[21] Appl. No.: 09/019,993

[22] Filed: Feb. 6, 1998

[51] Int. Cl.[6] ..... A45C 13/02

[52] U.S. Cl. ..... 190/110; 190/109; 206/287

[58] Field of Search ..... 190/36, 100, 109, 190/110; 206/278, 287

[56] References Cited

U.S. PATENT DOCUMENTS

| | | | |
|---|---|---|---|
| 1,490,001 | 4/1924 | Gaynor | 190/110 |
| 2,107,180 | 2/1938 | Gihon, III | 190/110 |
| 3,306,404 | 2/1967 | Yellin | 190/110 |
| 4,580,667 | 4/1986 | Herwood | 190/110 |
| 4,854,432 | 8/1989 | Carpenter et al. | 190/110 |
| 5,150,776 | 9/1992 | Rebenack | 190/110 |
| 5,195,620 | 3/1993 | Tate | 190/110 X |
| 5,505,297 | 4/1996 | Myers | 190/36 X |
| 5,593,038 | 1/1997 | Lyon | 206/278 X |
| 5,676,223 | 10/1997 | Cunningham | 190/110 X |

FOREIGN PATENT DOCUMENTS

| | | | |
|---|---|---|---|
| 530067 | 3/1993 | European Pat. Off. | 190/100 |
| 625061 | 9/1961 | Italy | 190/109 |
| 2184938 | 7/1987 | United Kingdom | 190/110 |

*Primary Examiner*—Sue A. Weaver
*Attorney, Agent, or Firm*—Kenneth F. Kozik

[57] ABSTRACT

A garment separator having a generally rectangularly shaped section of taffeta, the taffeta having an upper strip of nylon tape and a lower strip of nylon tape, and the upper strip of nylon tape fitted to mate with a nylon tape affixed to a receptor zone of a garment carrier. A method of reducing wrinkling of garments in a garment carrying device including the steps of adapting the garment carrying device with a nylon tape in a receptor zone, placing a first garment in the garment carrying device, placing a generally rectangularly shaped taffeta section over the first garment, the taffeta section having a strip of nylon tape, attaching the taffeta section to the receptor zone by engaging the nylon tape of the receptor zone with the nylon tape of the taffeta section, placing a second garment over the taffeta section, and closing the garment carrying device.

1 Claim, 3 Drawing Sheets

METHOD AND APPARATUS OF MINIMIZING WRINKLES DURING THE TRANSPORTATION AND STORAGE OF GARMENTS

FIELD OF THE INVENTION

The present invention relates to the field of garments, and more particularly to an apparatus and method of separating garments and thus minimizing wrinkles in the transportation and/or storage of garments.

BACKGROUND OF THE INVENTION

As is well known, garments placed in storage devices of all types become wrinkled over a period of time. The garment wrinkling becomes exasperated when moved in these storage devices. For example, a traveler packs a garment bag, suitcase, and/or carry-on luggage with clothing needed for a trip. Typically upon arriving at a destination the traveler opens the garment bag, suitcase, and/or carry-on luggage only to find that clothing which had been originally wrinkled-free when loaded into the storage device now looks like it was "slept in." This is particularly acute for a business traveler who must go from destination to destination and look sharp and neat at each stop.

Over the years many approaches have been used to minimize or reduce the wrinkling of stored garments. One such approach is to place cardboard partitions between articles of clothing in order to minimize contact between the clothing, and thus wrinkling. With this approach static electricity may build up when the clothing rubs against the cardboard which results in wrinkled clothing. In addition, cardboard partitions may slip out of place during transport of the stored garments.

In another approach, individual clothing is wrapped in various types of plastic and then placed in the storage device. Here again, static electricity may build up which results in wrinkled clothing.

In still another approach, sheets of stiff plastic are positioned between articles of clothing and packed in a storage device. With this approach, storage of the stiff plastic itself between trips is cumbersome, and wrinkles in plastic typically result in wrinkles in clothing. In addition, the insertion of stiff plastic prevents the stored garments from being folded upon themselves, which is commonly done during transportation of garments.

In another approach, cellophane is placed between articles of clothing or around each article of clothing as the clothing is put in a storage device. In this method, the cellophane can crinkle up during transportation of the garments. In addition, the fragile nature of cellophane typically allows it to be used only once before it must be disposed up.

What is needed is a lightweight, inexpensive, convenient, and versatile method and apparatus to minimize or reduce the accumulation of wrinkles in garments being transported and/or stored, which can be easily adapted to the needs and requirements of the traveler and his garments.

SUMMARY OF THE INVENTION

In accordance with the principles of the present invention a garment separator is provided having a generally rectangularly shaped section of taffeta, the taffeta having an upper strip of nylon tape and a lower strip of nylon tape, and the upper strip of nylon tape fitted to mate with a nylon tape affixed to a receptor zone of a garment carrier.

Furthermore, a method of reducing wrinkling of garments in a garment carrying device including the steps of adapting the garment carrying device with a nylon tape in a receptor zone, placing a first garment in the garment carrying device, placing a generally rectangularly shaped taffeta section over the first garment, the taffeta section having a strip of nylon tape, attaching the taffeta section to the receptor zone by engaging the nylon tape of the receptor zone with the nylon tape of the taffeta section, placing a second garment over the taffeta section, and closing the garment carrying device.

BRIEF DESCRIPTION OF THE DRAWINGS

The novel features believed characteristic of the invention are set forth in the appended claims. The invention itself, however, as well as features and advantages thereof, will be best understood by reference to the detailed description of specific embodiments which follows, when read in conjunction with the accompanying drawings, wherein:

DETAILED DESCRIPTION OF THE PREFERRED EMBODIMENT(S)

Figure 1:
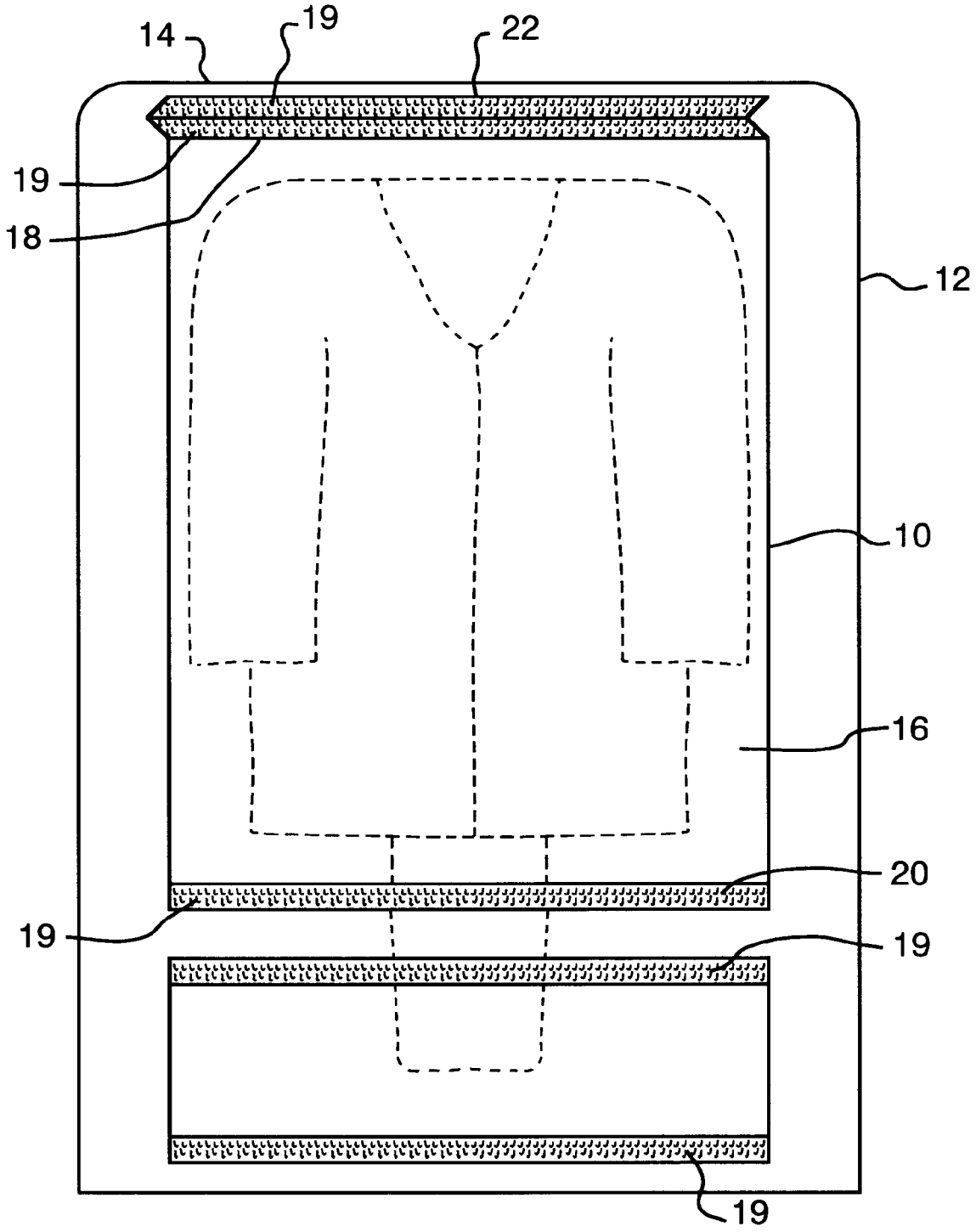
FIG. 1 is a block diagram of a garment separator in accordance with the principles of the present invention in one exemplary embodiment.

Referring to FIG. 1, a garment separator 10 in accordance with the principles of the present invention is shown, by way of example, mounted inside a garment bag 12. The exemplary garment bag 12 is shown as a generally rectangularly-shaped structure with its internal top section 14 generally rigid. The interior of the top section 14 in the exemplary garment bag 12 is typically adapted to hang or suspend garments (shown in tandem by way of example) in the garment bag 12. This may be by way of an internal hangar, post, or other suitable fixture. Other embodiments of the invention may involve mounting the garment separator 10 in other garment-type carriers, such as suitcases, duffel bags, and gym bags.

The garment separator 10 is shown to include a primary garment separator section 16. In addition, the primary garment separator section 16 is shown to include an upper attachment zone 18 and a lower attachment zone 20. The upper attachment zone 18 of the primary separator section 16 is typically attached or affixed to the top section 14 via a receptor zone 22. In addition, more than one garment separator may be attached or affixed to the top section 14 as would be required if more than two garments (not shown) are hung in the exemplary garment bag 12. Where more than one garment separator is utilized, each is affixed separately to the receptor zone 22 of the top section 14, as will be described below.

In the exemplary embodiment of the garment separator 10 the overall length and width of the primary separator section 16 is preferred to cover a standard men's suit. In another embodiment of the present invention, the garment separator 10 may include additional primary separator sections 17 added end-to-end to increase the overall effective length of the garment separator 10.

The primary separator section 16 is attached to the garment bag 12 in the following manner. The upper attachment zone 18 of the primary separator section 16 consists of a nylon tape adapted to mate with a corresponding nylon tape. The top section 14 also includes a nylon tape. Thus, the upper attachment zone 18 provides attachment between the primary separator section 16 and the top section 14 as the nylon tape of the upper attachment zone 18 and the nylon tape of the top section 14 adhere on contact. Preferably, the nylon tapes used in the present invention are hook and loop fasteners. More preferably, the hook and loop fasteners (collectively referred to as 19 in the figures) used in the present invention are hook and loop fasteners 19 which are supplied by Velcro Industries and are trademarked under the name of Velcro® brand hook and loop fasteners.

As was described above, the primary garment separator section 16 includes a lower attachment zone 20. The lower attachment zone 20 provides attachment between the primary separator section 16 and additional primary separator sections 17 of additional garment separators (not shown). Thus, one or more additional primary separator sections 17 may be added to the present invention as required by the size ofthe garment being used by attachment of corresponding nylon tapes.

In the exemplary embodiment of the present invention shown in FIG. 1, an upper portion the primary separator section 16 is contoured and shaped to mate with the corresponding contour and shape of the top section 14. In alternate embodiments, the upper portion of the primary separator section 16 may be square, or may be designed to adapt to a wide range of shapes and contours to match and mate with the garment and/or storage device employed.

In the preferred embodiment of the invention, the primary separator section 16 is made of taffeta. In the preferred embodiment taffeta provides hanging garments (not shown) separated by the garment separator 10 a decreased resistance and static electricity to reduce the wrinkling of garments contained within. In addition, the garment separator 10 allows any garment contained in the garment bag to freely slide over it.

Figure 2:
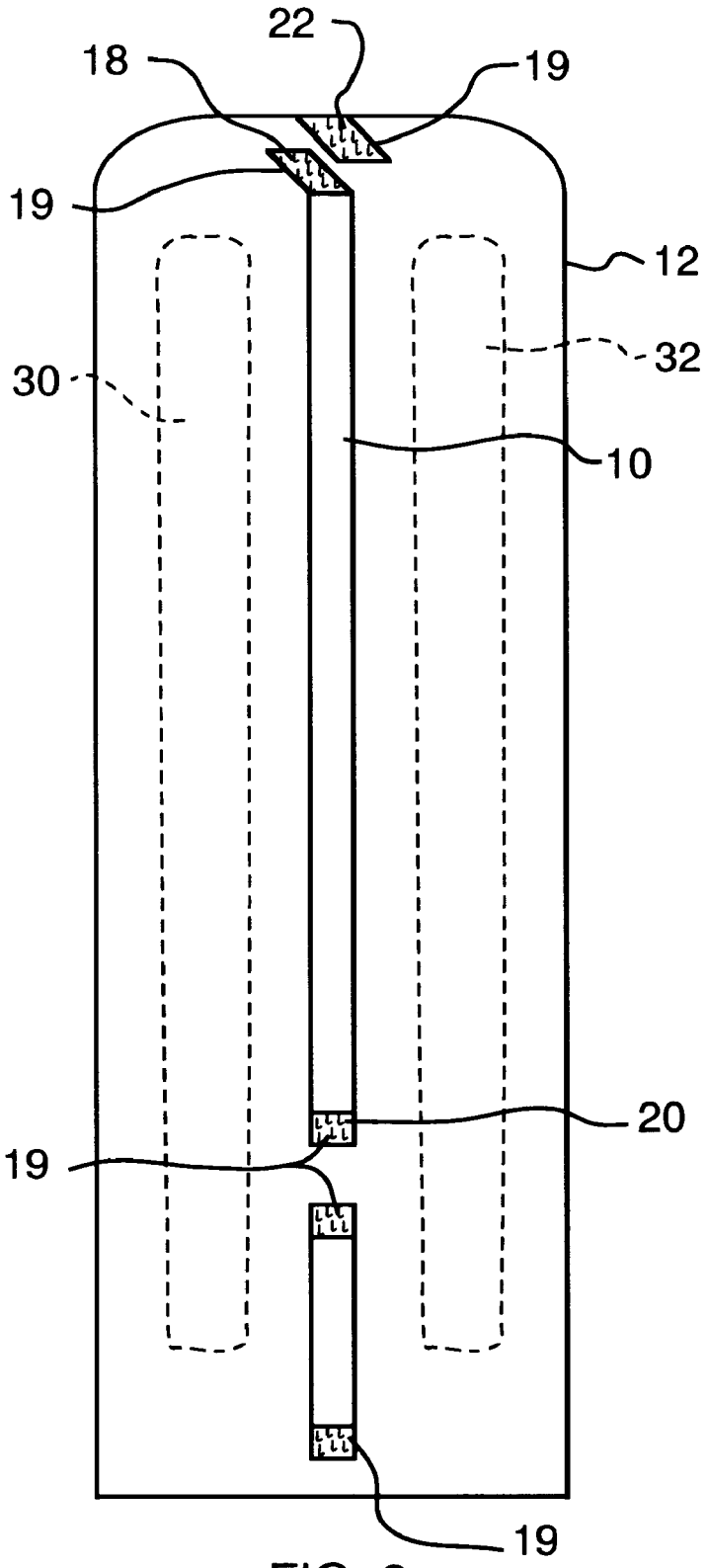
FIG. 2 is a block diagram of the garment separator of FIG. 1 shown in cross-section.

Referring to FIG. 2, the garment separator 10 of FIG. 1 is shown in cross-section. In FIG. 2, the garment separator 10 is shown positioned between a first article of clothing 30 and a second article of clothing 32, thereby minimizing wrinkles during their transportation and storage in the exemplary garment bag 12. As was mentioned above, the garment separator 10 may be adapted to any length of clothing by the inclusion of additional primary separator sections (not shown).

Figure 3:
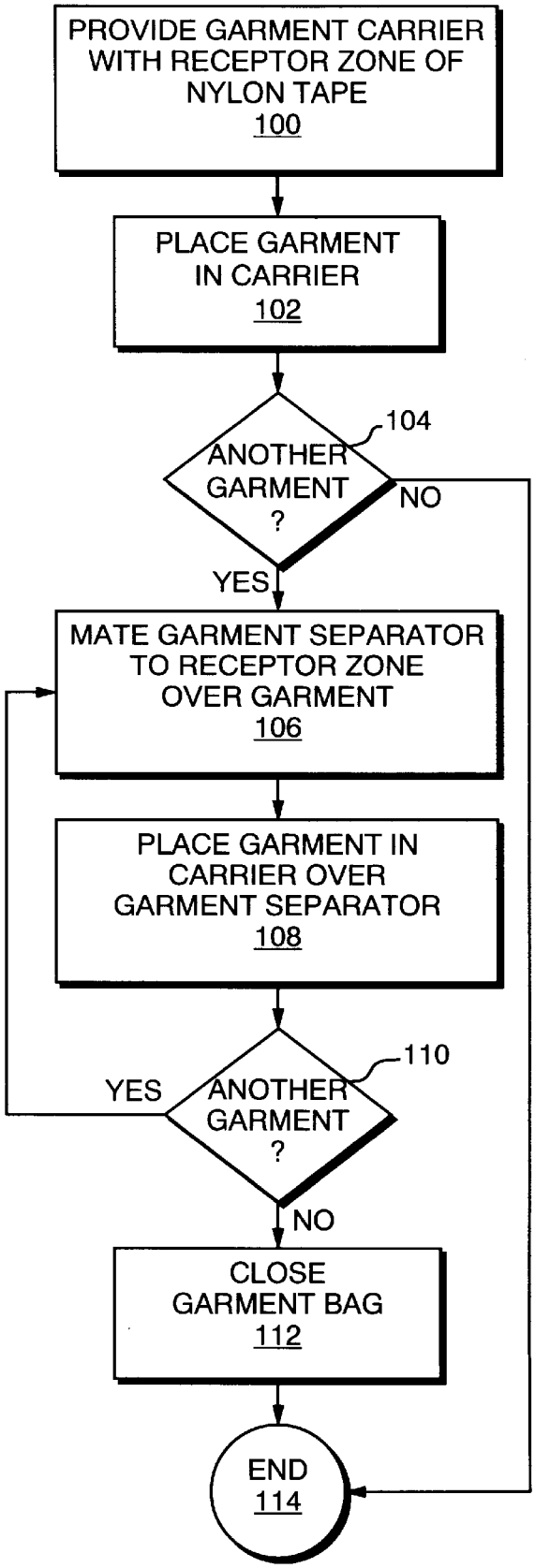
FIG. 3 is a flow diagram of one exemplary embodiment according to the principles of the present invention.

Referring to FIG. 3, at step 100, a method of reducing wrinkles begins with providing a garment carrier having an internal receptor zone of nylon tape. At step 102 a first garment is placed in the garment carrier. At step 104, if another garment is to be added, then proceed to step 106, else proceed to step 112. At step 106 a garment separator having a nylon tape is mated to come in contact with the receptor zone over the garment. At step 108, a second garment is placed over the garment separator.

At step 112, if no additional garments are to be placed into the garment carrier, the garment carrier is closed and ready to be transported. At Step 110, if additional garments are to be placed into the garment carrier, then steps 106 and 108 are repeated. At step 114 the method ends.

Having described a preferred embodiment of the invention, it will now become apparent to those skilled in the art that other embodiments incorporating its concepts may be provided. It is felt therefore, that this invention should not be limited to the disclosed invention, but should be limited only by the spirit and scope of the appended claims.

What is claimed is:

1. A garment bag for containing a plurality of garments in a reduced wrinkle condition comprising:

a receptor, the receptor having a loop and hook fastener;

a generally rectangularly shaped first section of taffeta, the first taffeta section having an upper loop and hook fastener and a lower loop and hook fastener;

an attachment zone wherein the upper loop and hook fastener is fitted to mate with the receptor loop and hook fastener to provide separation of the plurality of garments by the first section of taffeta;

a second generally retangularly shaped taffeta section, the second taffeta section having an upper hook and loop fastener and a lower hook and loop fastener; and the second taffeta section attached to the first taffeta section through a contact of upper hook and loop fastener of the second taffeta section with the lower hook and loop fastener of the first taffeta section to provide an additional length of separation of the plurality of garments.

* * * * *